US007203975B2

(12) United States Patent
Vierkant, III

(10) Patent No.: US 7,203,975 B2
(45) Date of Patent: Apr. 17, 2007

(54) RELEASABLE TOILET SEAT HINGE ASSEMBLY

(75) Inventor: Erich C. Vierkant, III, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 242 days.

(21) Appl. No.: 10/949,132

(22) Filed: Sep. 24, 2004

(65) Prior Publication Data

US 2006/0064808 A1 Mar. 30, 2006

(51) Int. Cl.
*A47K 13/12* (2006.01)

(52) U.S. Cl. ..... 4/240; 4/236

(58) Field of Classification Search ..... 4/236, 4/240

See application file for complete search history.

(56) References Cited

U.S. PATENT DOCUMENTS

| | | | |
|---|---|---|---|
| 4,159,548 | A | 7/1979 | Hewson |
| 4,326,307 | A | 4/1982 | Baillie et al. |
| 4,939,796 | A | 7/1990 | Pepper |
| 4,965,889 | A | 10/1990 | Tissot et al. |
| 5,933,875 | A | 8/1999 | Hulsebus et al. |
| 5,980,150 | A | 11/1999 | Newman et al. |
| 6,052,869 | A | 4/2000 | Suzuki |
| 6,070,295 | A | 6/2000 | Hulsebus |
| 6,381,762 | B1 | 5/2002 | Moser |

FOREIGN PATENT DOCUMENTS

| | | |
|---|---|---|
| GB | 2 280 219 | 1/1995 |

OTHER PUBLICATIONS

An Aug. 2002 advertisement for a Sani-Soft quick release hinge entitled "Learn About The Hinges".

*Primary Examiner*—Charles E. Phillips
(74) *Attorney, Agent, or Firm*—Quarles & Brady LLP

(57) ABSTRACT

A hinge assembly is provided for connecting a toilet seat and cover to a rearward extension behind a toilet bowl. A base member is permanently affixed to the extension. A hinge support member is rotatably linked to the base member in bayonet connection fashion. The hinge support, seat and cover can be removed from the, leaving only the base attached to the extension.

13 Claims, 4 Drawing Sheets

FIG. 7
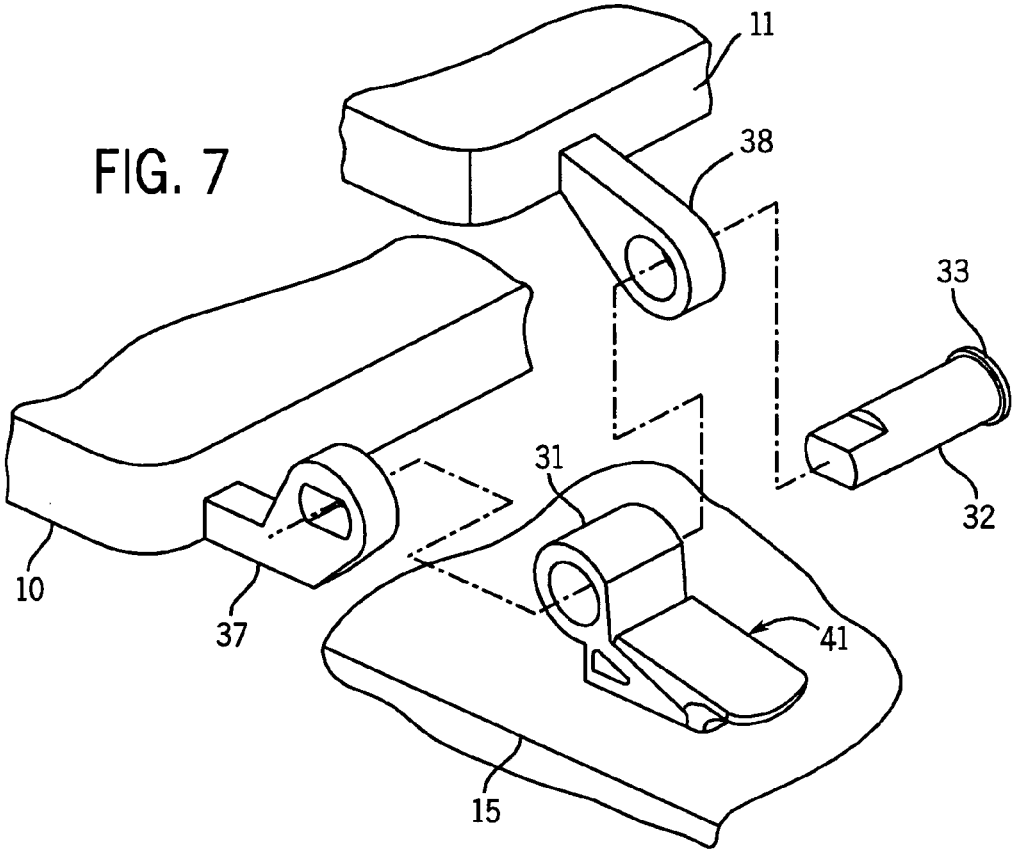
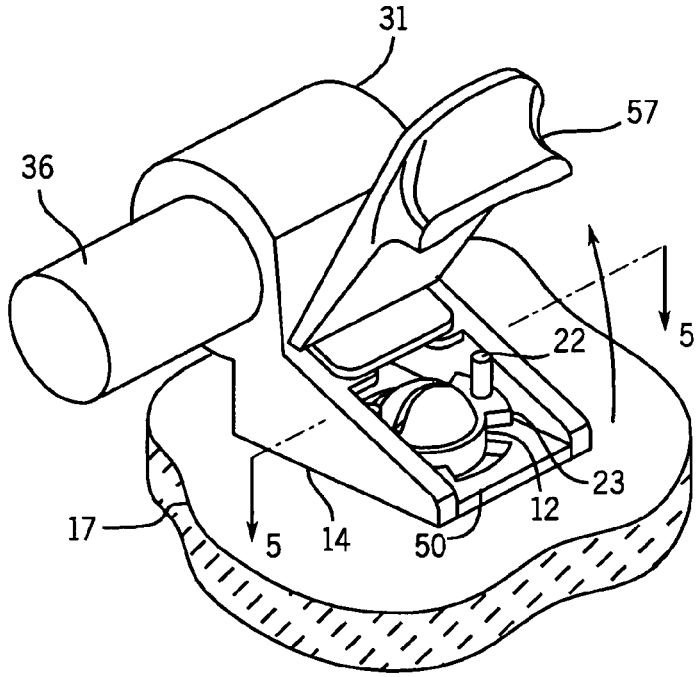
FIG. 8

RELEASABLE TOILET SEAT HINGE ASSEMBLY

CROSS-REFERENCE TO RELATED APPLICATION

Not applicable.

STATEMENT OF FEDERALLY SPONSORED RESEARCH/DEVELOPMENT

Not applicable.

BACKGROUND OF THE INVENTION

The present invention relates to hinges for mounting toilet seats and/or covers to the top of rearward extensions of toilets. More particularly it relates to such hinge assemblies that permit most of the assembly parts to be readily removed from the toilet to facilitate cleaning.

In designing toilet hinge assemblies, it is preferred to design systems that can easily be installed by untrained consumers. Thus, many such hinge assemblies pre-assemble the hinge to the seat and cover, and then affix the assembly via hinge posts to a rearward extension of a toilet bowl. In such constructions the posts are typically bolted to the rearward extension using a bolt-like fastener that extends down through the extension. A nut or similar device is then screwed onto the fastener from underneath the rearward extension to clamp the assembly to the extension.

Since the consumer may need access to the underside of the extension to adjust the nut during assembly or removal, and in any event the assembly or removal can require tools in some of these designs, these assemblies are intended to be essentially permanently affixed (with perhaps an occasional tightening if the seat works its way loose). This can create a problem because the area around such hinge posts (behind and under the cover and seat) can be difficult to completely clean. In this regard, urine and other contaminants can collect around the hinge posts, with the subsequent development of an undesirable appearance or smell, or unsanitary conditions.

As such, there have been a number of attempts to develop toilet seat hinge assemblies where the seat and cover and associated pivot pins can be removed from the toilet relatively easily, and then (after cleaning) be relatively easily reconnected. See e.g. U.S. Pat. Nos. 4,159,548, 4,326,307, 4,965,889, 5,933,875, and 6,070,295. See also GB 2,280,219 A.

These systems do achieve better cleaning by leaving only small hinge posts essentially permanently affixed to the bowl rearward extension, while providing readily releasable subassemblies that can removably link up with these posts. However, these prior art systems have a variety of deficiencies.

For example, some rely on a relatively weak connection between the subassembly and hinge posts such that the subassembly can accidentally be knocked off the posts. Others rely on relatively weak parts which may have a high incidence of breakage over prolonged use. Still others require relatively complex multi-part assemblies, which increase the cost of production and may require some consumer training.

Still other assemblies require tools for the disassembly for cleaning purposes. Yet others require a consumer to touch portions of the assembly that may themselves be contaminated.

Hence, it can be seen that a need still exists for an improved toilet seat hinge assembly, particularly one which facilitates removal of the seat and cover for cleaning purposes.

BRIEF SUMMARY OF THE INVENTION

The present invention provides a hinge assembly for linking a toilet covering element (e.g. a toilet seat, a toilet cover, or a toilet seat/cover combination) to a rearward portion of the toilet. The preferred mounting location is a horizontal upwardly facing surface of a rearward extension of a toilet bowl.

The hinge assembly has a base member adapted to be mounted adjacent the rearward portion of the toilet, the base member having a non-circular locking element, the locking element having a radially extending flange with an undercut beneath it. There is also a hinge support member adapted to support the toilet covering element, the hinge support member having a wall with a non-circular opening sized and dimensioned to receive the non-circular locking element.

The hinge support member is positionable over the base member such that the flange of the base member can pass into the non-circular opening of the hinge support member. Thereafter, rotation of the base member relative to the hinge support member can cause the flange to catch the hinge support member to lock the hinge support member to the base member.

In preferred forms the non-circular locking element includes at least one pin extending vertically there from. Relative rotation of the base member with respect to the hinge support member when the flange of the base member is above the non-circular opening can be restricted by a rotational stop of the hinge support contacting the pin. The pin may also facilitate rotational adjustments of the base position relative to the toilet when the fastener is nearly tightened in place.

The fastener can be a bolt having a threaded lower end and a slotted head. A nut can be threaded onto the lower end.

In especially preferred forms the hinge support member has a pivotable cover for covering and uncovering a top portion of the base member. This provides a clean appearance.

The hinge support member can be connected to a hinge pin. This provides an essentially horizontal pivot axis for the toilet covering element.

Where two such assemblies are positioned at opposed sides of the rear of the seat/cover, disconnection of the hinge support from the base is achieved by slightly loosening the bolts, pushing the pins to cause the bases to rotate slightly, and then lifting the hinge supports with seat and cover attached thereto from the bases.

Alternatively, one assembly of the present invention could be at a rear corner of the seat and cover, with another type of quick release assembly being used at the other corner (e.g. see U.S. Pat. No. 4,326,307). Once that other assembly is disconnected, the hinge support of the present invention can be rotated relative to the base and then lifted, without any loosening of the bolt.

In another form, the invention provides another such hinge assembly. This assembly has a base member adapted to be mounted adjacent the rearward portion of the toilet, the base member including a rotational locking element having at least one flange with an undercut beneath it. It also has a hinge support member adapted to support the toilet covering element, the hinge support member having a wall with a non-circular opening sized and dimensioned to receive the rotational locking element, the height of the wall being selected to provide a frictional contact with the undercut of the locking member.

The non-circular opening in the hinge support member is selectively positionable over the locking member of the hinge support member. Thereafter, rotation of the locking element causes the flange to rotate over the wall of the hinge support member to lock the base member to the hinge support member.

In preferred forms of this embodiment, the rotational locking element has a central portion having an aperture for receiving a fastener for mounting the base to the toilet bowl, first and second flanges extending radially from the central portion, and a first and a second post extending vertically from the flanges.

The hinge support member is adapted to support the toilet seat/cover in a pivotable fashion. This can be achieved in a number of ways. For example, it can be achieved via an essentially horizontally extending pin which forms a pivot axis for the seat and cover (compare pin 64 in U.S. Pat. No. 4,159,548), or via a more complex dash pot type "pin" (compare U.S. Pat. No. 6,052,869).

Typically, such seats and covers both have a pair of spaced rearwardly extending ears, with cross holes extending through or at least into all of the ears. For example, a pin can extend through a seat left rear ear and then into a cover left rear ear, and another pin (or that pin) can extend through a cover right rear ear and into a seat right rear ear.

Where the hinge support member has a pivotable cover for covering and uncovering the top of the base member, movement of the cover provides access to a slotted head of the fastener, and also to the pin(s) of the base.

It will be appreciated that once the hinge supports are removed from the base members the rear bowl extension can be more easily and effectively cleaned. One can then reassemble the pre-assembled seat/cover/hinge support assembly by lowering the hinge support (or supports) onto the base elements, followed by relative rotation of the hinge support(s) with respect to the base(s). The flange extensions of the base(s) catch over the lower wall(s) of the hinge support(s) in bayonet connection fashion.

This fixes the hinge support(s) to the base(s) (and thus the seat and cover) to the bowl rearward extension. The toilet seat and cover can then pivot in the usual fashion as needed.

When removal of the main parts of the assembly is desired for cleaning, one may reverse the rotation. This permits everything but the base member(s) and associated nut/fastener to be vertically lifted up away from the toilet.

It will be appreciated that the hinge assembly of the present invention has a number of important advantages. For one thing, it is comprised of few parts and thus can be inexpensively manufactured. Further, its mechanism of operation does not require a consumer to touch an area of the assembly that is likely to be contaminated.

Moreover, the connection is solid, thereby precluding accidental undesired dislodging of the assembly. Further, the parts can be formed to present an aesthetically pleasing appearance.

In one embodiment, the hinge support member always shrouds the base. Thus, to tighten or remove the base the hinge support member is removed. However, in another embodiment the hinge support member has a pivotable cover which when open provides access to the top of the base. In this embodiment, the entire assembly can be removed as a unit, or installed as a unit.

These and still other advantages of the present invention will be apparent from the description that follows. The claims should be looked to in order to judge the full scope of the invention.

BRIEF DESCRIPTION OF THE DRAWINGS

FIG. 7 is a partially exploded view of FIG. 1, albeit with the hinge assembly still attached to the bowl;

FIG. 8 is a view of an alternate embodiment of a hinge support of the present invention, where the hinge support has an integral hinge pin;

DETAILED DESCRIPTION OF THE INVENTION

Figure 1:
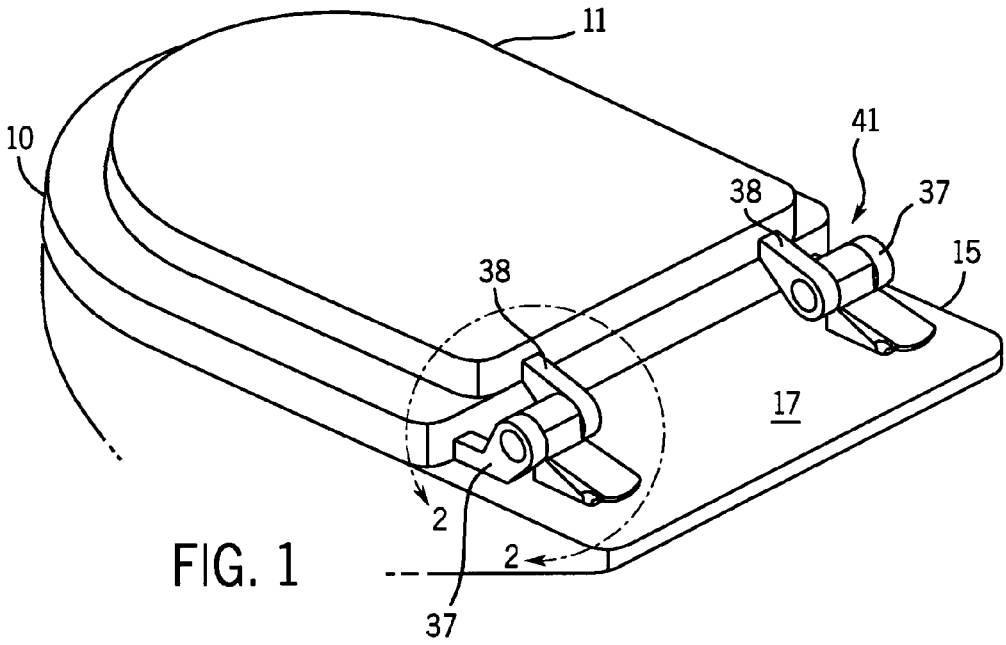
FIG. 1 is a rear perspective view showing two hinge assemblies of the present invention mounted on a toilet bowl rear extension to retain a toilet seat and cover.
Figure 2:
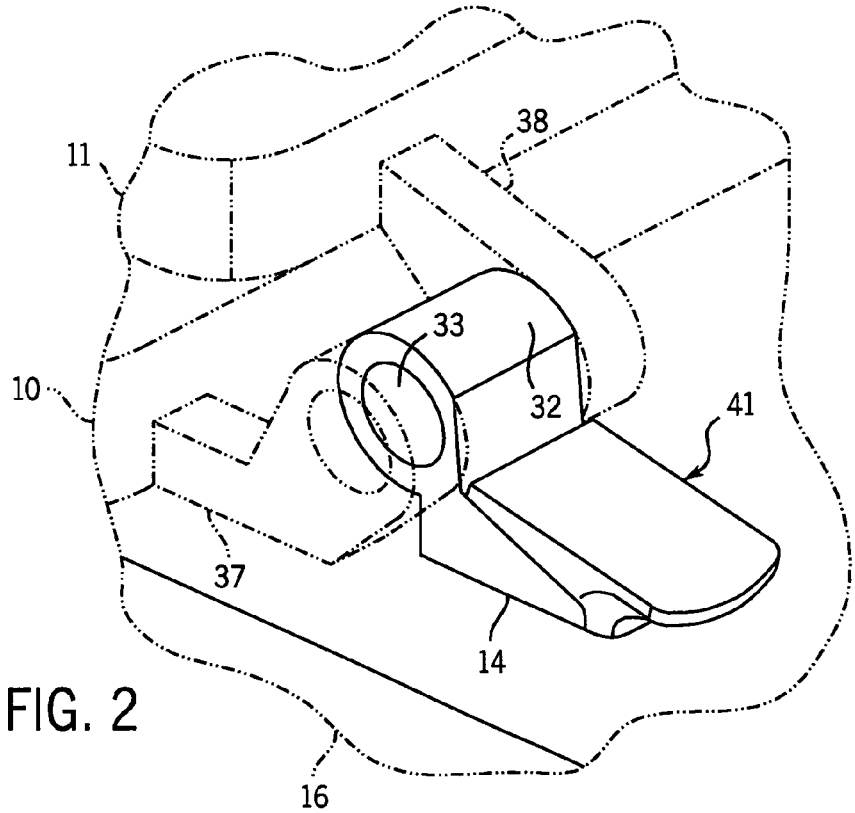
FIG. 2 is an enlarged perspective view of one such assembly focusing around region 2—2 of FIG. 1, with its environment of use shown in dotted lines.
Figure 3:
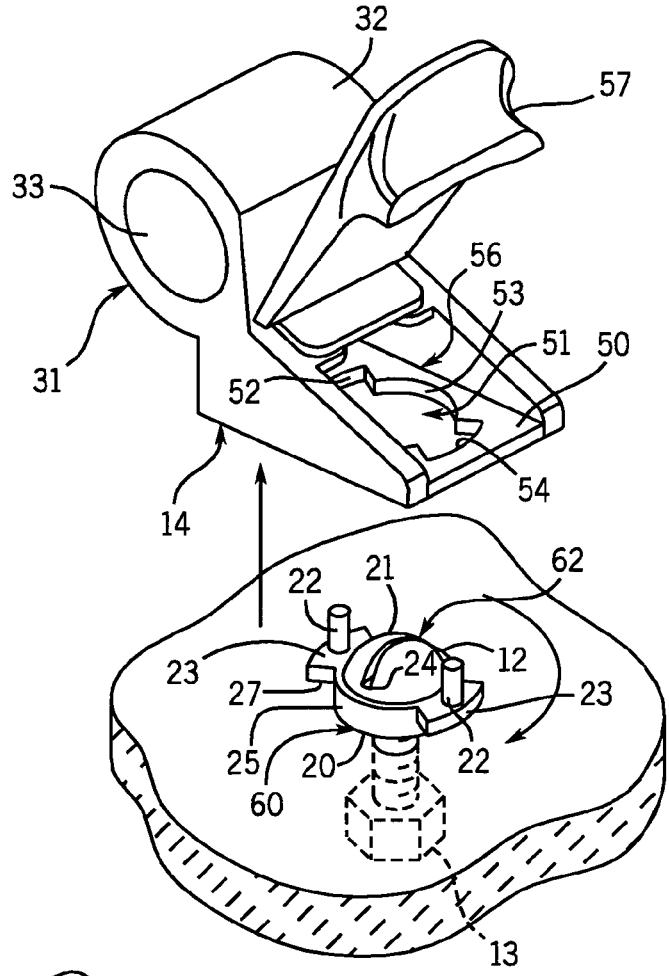
FIG. 3 is an exploded perspective view of a hinge assembly of the present invention, with a portion mounted on a piece of the bowl rear extension.
Figure 4:
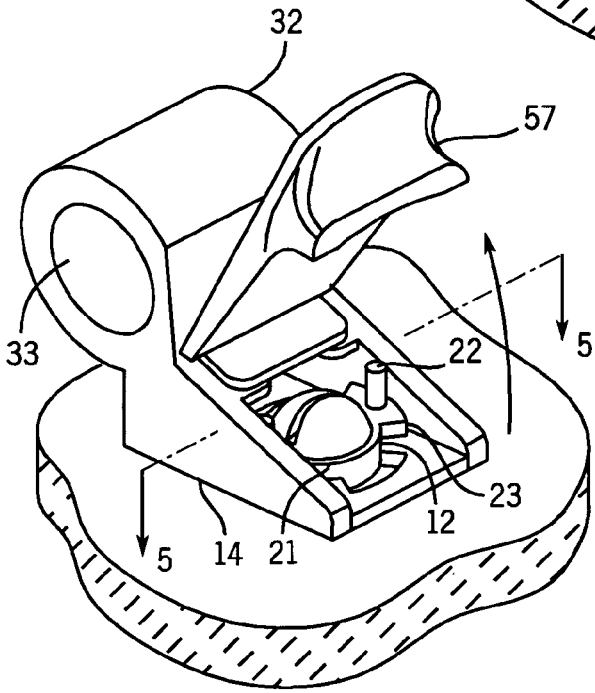
FIG. 4 is a perspective view of the assembly of FIG. 3, but in assembled form.
Figure 5:
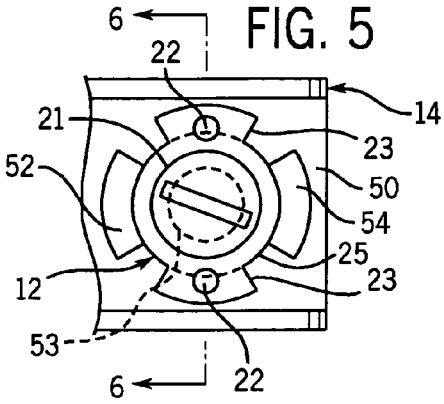
FIG. 5 is a top view taken generally along portion 5—5 of FIG. 4.

Referring first to FIGS. 1–3, a toilet is shown having a conventional seat 10 and seat cover 11 coupled to a conventional base 17 through two hinge assemblies 41 of the present invention. The seat 10 and cover 11 both have rearward corner mounting ears 37/38 which extend over a rear extension 15 from the bowl portion of the base 17. The ears 37/38 are provided with the usual horizontal bores for receiving a mounting pin or pintle from a hinge support 14 to pivotally mount the covering members 10/11 with respect thereto.

There are two bases 12 mounted on the rear extension 15, and two hinge support members 14 connectible thereto. Each base 12 includes an integral locking portion 20 and bolt 21. The bolt 21 may have a slotted head 24. Alternatively, the bolt fastener may be integrally formed with the locking portion so that it has a depending threaded lower stem.

The locking element 20 includes a central portion 25 (with a hole there through when the separate bolt 21 is used), and opposed first and second flanges 23 extending radially outward there from. A pair of vertical posts 22 extend vertically upward from, and are substantially centered on, these flanges 23.

Figure 6:
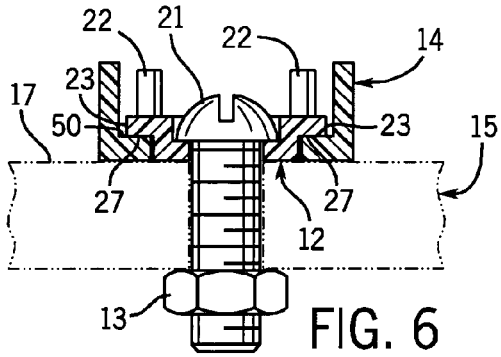
FIG. 6 is a vertical sectional view taken along line 6—6 of FIG. 5.

As will be appreciated from FIGS. 3 and 6, flanges 23 both include an undercut portion 27 to allow the flanges 23 to rotate over a portion of a bottom wall 50 of the hinge support 14, and therefore to lock the hinge support 14 in place when that has occurred.

Each base 12/bolt 21 is mounted to the rearward extension 15 of the toilet bowl 17 through a vertical through hole which extends through the top of the extension 15 and ends at an accessible portion of the bowl 17. The lower threaded end of the bolt 21 is designed to extend through the extension 15 such that a portion of the bolt 21 extends beneath the extension 15.

A nut 13 can then be threaded onto the bolt to clamp base 12 in place. This is a relatively permanent connection, as a tool would normally be needed to facilitate the removal.

The hinge support member 14 includes an upper horizontal tubular portion 31 which can be coupled to the mounting ears 37/38 to pivotally support the toilet covering members 10/11 along a horizontal axis over the toilet bowl 17. The portion 31 can be provided with a separate cylindrical pin 32 that is rotationally damped by a conventional dash pot 33. The dash pot 33 can be of the type that permits the cover 10 and seat 11 to easily be lifted from horizontal to vertical, but damps downward rotation so that the covering elements 10/11 can only slowly rotate downward, thereby preventing them from banging on the top of the toilet bowl 17 if they are accidentally dropped.

Alternatively, as indicated in FIG. 8, pintle 36 can be integrally formed with the hinge support 14. In any event, the specific structure of such pins/pintles and how they interact with the mounting ears 37 and 38 of such toilet seats and covers are well known in the art.

The hinge support member 14 also includes a horizontal lower wall 50 adapted to be mounted on the top of the toilet bowl 17. A non-circular opening 51, having a central portion 53 and side lobes 52 and 54, is provided in the wall 50. It permits the flanges 23 and central base portion 25 to pass through the opening when the base is oriented relative to the hinge support 14 as shown in FIG. 3.

The hinge support 14 also has an internal cavity 56 above the opening which can be closed by a pivotable cover 57. The pivotable cover 57 can either be integral with the hinge support 14 or formed as a separate piece and anchored via legs (not shown).

To connect a subassembly (including at least one hinge support member 14 and associated toilet cover 10 and seat 11) to a base 12, the hinge support 14 is aligned with the base 12, dropped down over it, and then rotated relative to the base 12 until the flanges 23 can no longer back out pass through openings 52 and 54.

After relative rotation of the base 12 with respect to the hinge support 14 has caused the flanges 23 to rotate over the top of the wall 50, a frictional connection between the flanges and wall hold that rotational position. As a result the hinge support 14 is "locked" to the base 12.

Figure 9:
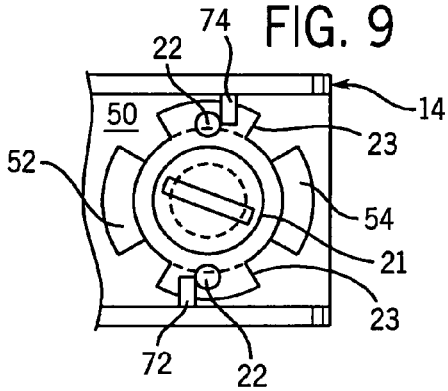
FIG. 9 is a view similar to FIG. 5, but showing the interior of the hinge support being provided with rotational stops.

Note that the upper surface of wall 50 can be sloped upward in the direction of rotation (not shown), so that relative rotation between the base 12 and hinge support 14 becomes very difficult once the parts are in or near the locking position. As depicted in FIG. 9, stops 72 and 74 can extend inward from the side walls of the hinge support 14 to provide a positive rotational stop by limiting movement of vertical posts 22.

Hence, posts 22 serve a rotational limit function. They also can be used to facilitate minor adjustments in the positioning of the base when the base is first being installed on the toilet. Alternatively, they could be used to facilitate unlocking.

It should be appreciated from FIG. 9 that the covering members 10 and 11 with hinge support 14 can be disconnected as a unit from the base 12 by rotating the base 12 in the reverse direction until the flanges 23 realign with the lobes 52 and 54 of the opening 51. At this point, the subassembly of seat 10, cover 11 and two hinge supports 14 can be lifted up from the bowl 17 to permit cleaning.

Figure 10:
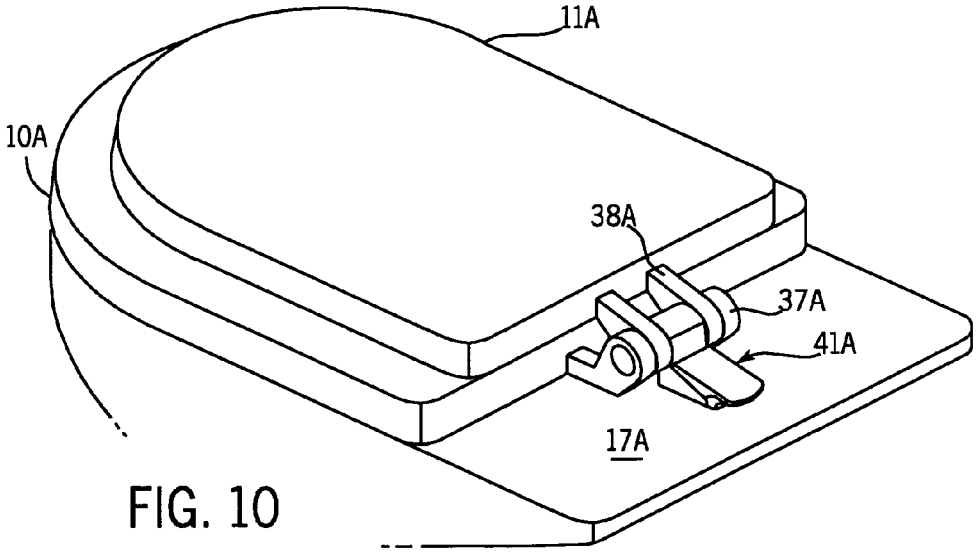
FIG. 10 is a view similar to FIG. 1, but of another embodiment where a single such hinge assembly is used to mount the cover and seat.

An alternate embodiment is shown in FIG. 10 in which a single hinge assembly 41A couples the toilet covering members 10A/11A to the toilet bowl 17A. Corresponding ears 37A and 38A are used. Somewhat longer pintles may be desirable for this type of design.

While the preferred embodiments have been described above, a wide variety of changes can be made to them without departing from the spirit or scope of the invention. For example, although a specific non-circular configuration for the base opening has been described, it will be apparent that various non-circular configuration could be used. Additionally, if only one hinge of the present invention is used, yet a second hinge is desired, the second hinge can be of a variety of different configurations.

Further, it is not necessary that there be both a cover and seat. Either can be attached alone if desired (e.g. for a public restroom just a seat is more typical). Thus, the claims should be looked at in order to judge the full scope of the invention.

INDUSTRIAL APPLICABILITY

The present invention provides an improved hinge assembly suitable to attach a toilet seat and/or cover to a toilet.

I claim:

1. A hinge assembly for linking a toilet covering element to a rearward portion of the toilet, the assembly, comprising:

a base member adapted to be mounted adjacent the rearward portion of the toilet, the base member including a non-circular locking element, the locking element having a radially extending flange with an undercut beneath it; and a hinge support member adapted to support the toilet covering element, the hinge support member having a wall with a non-circular opening sized and dimensioned to receive the non-circular locking element;

wherein the hinge support member is positionable over the base member such that the flange of the base member can pass into the non-circular opening of the hinge support member, and such that thereafter rotation of the base member relative to the hinge support member can cause the flange to catch the hinge support member to lock the hinge support member to the base member.

2. The hinge assembly of claim 1, wherein the toilet covering element is selected from the group consisting of toilet seats, toilet covers, and combined toilet seats and covers.

3. The hinge assembly of claim 1, wherein the non-circular locking element includes at least one pin extending vertically there from.

4. The hinge assembly of claim 3, wherein relative rotation of the base member with respect to the hinge support member when the flange of the base member is above the non-circular opening can be restricted by a rotational stop contacting the pin.

5. The hinge assembly of claim 1, further comprising a fastener in contact with the base, the fastener having a lower threaded end.

6. The hinge assembly of claim 5, further comprising a nut suitable to be threaded on the lower threaded end.

7. The hinge assembly of claim 1, wherein hinge support member has a pivotable cover for covering and uncovering a top portion of the base member.

8. The hinge assembly of claim 5, wherein the fastener has a slotted upper head.

9. The hinge assembly of claim 1, wherein the hinge support member is connected to a hinge pin so as to provide an essentially horizontal pivot axis for the toilet covering element.

10. A hinge assembly for linking a toilet covering element to a rearward portion of the toilet, the assembly, comprising:

a base member adapted to be mounted adjacent the rearward portion of the toilet, the base member including a rotational locking element having at least one flange with an undercut beneath it; and a hinge support member adapted to support the toilet covering element, the hinge support member having a wall with a non-circular opening sized and dimensioned to receive the rotational locking element, the height of the wall being selected to provide a frictional contact with the undercut of the locking element;

wherein the non-circular opening in the hinge support member is selectively positionable over the locking element of the base member and wherein thereafter rotation of the locking element causes the flange to rotate over the wall of the hinge support member to lock the base member to the hinge support member.

11. The hinge assembly as defined in claim 10, wherein the rotational locking element comprises a central portion having an aperture for receiving a fastener for mounting the base member to the toilet.

12. The hinge assembly as defined in claim 11, wherein the rotational locking element comprises first and second flanges extending radially from the central portion.

13. The hinge assembly as defined in claim 12, further comprising a first and a second post extending vertically from the flanges.

* * * * *

UNITED STATES PATENT AND TRADEMARK OFFICE

CERTIFICATE OF CORRECTION

PATENT NO. : 7,203,975 B2
APPLICATION NO. : 10/949132
DATED : April 17, 2007
INVENTOR(S) : Erich C. Vierkant, III It is certified that error appears in the above-identified patent and that said Letters Patent is hereby corrected as shown below:

Column 4, Lines 53-53
"locking portion so" should be
--locking portion 20 so--

Signed and Sealed this

Twenty-third Day of October, 2007

JON W. DUDAS
*Director of the United States Patent and Trademark Office*